United States Patent [19]

Jarosz et al.

[11] Patent Number: 4,460,886

[45] Date of Patent: Jul. 17, 1984

[54] PRESSURE-OPERATED SWITCH FOR A CURRENT-LIMITING, HIGH-VOLTAGE INTERRUPTING MODULE

[75] Inventors: John M. Jarosz, Skokie; William R. Panas, Glenview, both of Ill.

[73] Assignee: S&C Electric Company, Chicago, Ill.

[21] Appl. No.: 437,926

[22] Filed: Nov. 1, 1982

[51] Int. Cl.[3] ..... H01H 71/20

[52] U.S. Cl. ..... 337/148; 337/190; 337/220

[58] Field of Search ..... 337/6, 148, 158, 159, 337/161, 162, 190, 220

[56] References Cited

U.S. PATENT DOCUMENTS

| | | | |
|---|---|---|---|
| 3,274,361 | 9/1966 | Ebensteiner et al. | 337/148 |
| 3,412,356 | 11/1968 | Van Horssen | 337/148 X |
| 4,344,058 | 8/1982 | Knapp et al. | 337/148 |

*Primary Examiner*—George Harris

*Attorney, Agent, or Firm*—John D. Kaufmann

[57] ABSTRACT

An improved switch in which a contact is moved away from a stationary contact by ignition of a power cartridge. The ignited power cartridge pressurizes a chamber defined by the stationary contact and an insulative trailer mounted to the movable contact to open the switch. The movable contact and its trailer move conformally through a bore of an insulative liner. The trailer and liner are made of ultra high molecular weight polyethylene which is abrasion-resistant and has high surface lubricity—thereby ensuring free movement of the movable contact and the liner—and which is non-brittle—thereby ensuring that forces applied to the trailer by the power cartridge do not shatter it. An inflexible disc of Lexan or Nylon may reside at the interface of the movable contact and the trailer to obviate extrusion of the trailer about the contact due to the forces applied to the trailer. If the switch is used to commutate current to a nearby fuse, the bore of the liner may be undercut to provide a volume into which the liner may expand when it is heated by operation of the fuse.

10 Claims, 1 Drawing Figure

PRESSURE-OPERATED SWITCH FOR A CURRENT-LIMITING, HIGH-VOLTAGE INTERRUPTING MODULE

BACKGROUND OF THE INVENTION

1. Field of the Invention

The present invention relates to an improved pressure-operated switch for a current-limiting, high-voltage interrupting module. More specifically, the present invention relates to an improvement of the switches and current-limiting, high-voltage interrupting modules disclosed and claimed in commonly assigned U.S. Pat. No. 4,342,978, issued Aug. 3, 1982 in the name of Meister, and the following commonly assigned U.S. Pat. applications: Ser. No. 188,660, filed Sept. 19, 1980, now U.S. Pat. No. 4,370,531, in the name of Tobin; Ser. No. 179,367, filed Aug. 18, 1980 in the name of Jarosz and Panas; Ser. No. 179,336, filed Aug. 18, 1980 in the name of O'Leary, and Ser. No. 437,925, filed Nov. 1,1982 in the names of Jarosz and Panas.

2. Prior Art

The above-noted commonly assigned patent and patent applications all relate to various aspects of a pressure-operated switch and to a current-limiting, high-voltage interrupting module containing the switch. The switch includes a pair of normally electrically interconnected contacts. The contacts may be normally electrically interconnected by direct abutment therebetween or by interconnecting them with a tearable or shearable metallic membrane or disk. In preferred embodiments of the switch, one of the contacts is stationary, while the other is movable, although both may be movable. The contacts are separable by the movement of one or both along a fixed line of direction to open a gap therebetween, thereby opening the switch. One of the contacts, preferably the stationary contact, contains a pocket which, in conjunction with a piston or trailer carried by the movable contact, defines a closed chamber. The chamber houses a power cartridge or similar pressure-generating ignitable device.

The switch is in shunt with a more or less typical current-limiting fuse. In preferred embodiments, the fusible element and the sand of the fuse, as well as the switch, are housed within a common housing. When the switch is closed, and when the contacts thereof are electrically interconnected, the resistance of the current path through the switch is much lower than resistance of the current path through the fusible element, and, accordingly, all or a majority of the current flowing through the module flows through the switch. In this way, the module may have a very high continuous current rating. Upon opening the switch, the contacts separate and current is rapidly commutated from the switch to the fusible element where the current is interrupted. Separation of the contacts is achieved by igniting the pressure cartridge, which evolves high pressure within the chamber. This high pressure acts against the trailer and the forces produced thereby rapidly drive the movable contact away from the stationary contact, breaking the normal electrical interconnection and opening the switch. The power cartridge may be ignited in response to the output signal of apparatus which senses a fault current or other over-current in a circuit to which the interrupting module is connected for protection thereof.

The movable contact and its trailer move away from the stationary contact and through a central bore of an insulative body or liner. Both the movable contact and the trailer are conformally received by the bore of the liner to physically isolate the moving contact from the ignition products of the power cartridge. This isolation prevents or suppresses the formation of any arc between the separating contacts. Additionally in the above patent and patent applications, both the trailer and the liner are preferably made of an arc-extinguishing material. In this way, it was postulated, if an arc does form between the separating contacts, the action of the heat of the arc on both the liner and on the trailer conformally received therein would cause the rapid evolution of cooling, de-ionizing and turbulent gases, which would extinguish the arc.

In addition to the conformal reception of both the contact and its trailer within the bore of the liner, the trailer itself is also normally conformally received within the pocket formed within the stationary contact. As a consequence of an relative movement between these conformally related parts, it has been found that the various insulative members may become abraded, thus impeding free movement of the movable contact to the detriment of positive operation of the switch.

As already noted in the preferred embodiments of inventions described in the above-noted patent and patent applications, it is preferred that the trailer and the liner be formed of an insulative, arc-extinguishing material. Experiments indicate, however, that it may not be necessary to make these elements out of an arc-extinguishing material. Briefly stated, although a small arc of short duration does at times momentarily form between the movable and stationary contacts upon separation therebetween, both the rapid commutation of current from the switch to the fusible element and the conformal reception of the trailer within the bore of the liner appear to result in extremely fast extinguishment of this small arc and thereafter arcing has typically not been noted. As a consequence, while conformal reception of the trailer is still desired to isolate the moving contact from the ignition products of the power cartridge, it may not, in certain use environments, be necessary to construct the trailer or the liner out of an arc-extinguishing material.

The ignition of the power cartridge causes high impact forces on the force receiving end of the trailer. It has been found that many insulative materials shatter, extrude or grossly deform upon receiving these impact forces. This may impede the free movement of the movable contact, and, again, may compromise the proper operation of the switch and of the module.

As already noted, the trailer and the movable contact are connected together. If the trailer is made out of some insulative materials, it has been found that the high impact forcees on the force receiving end thereof can cause the opposite end of the trailer to extrude around the movable contact at the point of connection therebetween. Again, this extrusion may compromise free movement of the movable contact, thereby compromising the operation of the switch.

Lastly, in the switches described in the above-noted patent and patent application, after the switch opens and current has been commutated to the fusible element, current interruption takes place therein. Such current interruption generates substantial amounts of heat and it has been found that, at times, sufficient heat is generated to cause substantial expansion of the various insulative members of the switch and, particularly, of the liner, through the bore of which the movable contact and the trailer conformally move. Experiments have shown that expansion of the liner can be sufficiently great so as to cause the housing for the module to become disintegral. It is desirable that the housing for the module remain integral before, during, and after its operation.

Accordingly, a general object of the present invention is to provide a desirable material for various insulative parts of the above-noted switches, which material is abrasion resistant, has high surface lubricity, and is non-brittle. Further, techniques for eliminating undesired extrusion or expansion of the various insulative parts is also a goal of the present invention.

SUMMARY OF THE PRESENT INVENTION

With the above and other objects in view, the present invention most broadly contemplates an improved high-voltage electrical switch for opening a current path in which the switch is included. The switch has a pair of normally interconnected contacts which are relatively movable apart along a fixed line of direction to form a gap therebetween. Formation of the gap opens the current path. An insulative trailer is carried by one of the contacts for defining an enclosed chamber with the other contact when the contacts are interconnected. The trailer is intimately and conformally receivable in and movable through the chamber. The switch also includes a facility for pressurizing the chamber and applying high force to the trailer to rapidly drive the contacts apart. Preferably, the pressure-generating facility is an ignitable power cartridge or similar device. Lastly, the switch includes an insulative liner through a bore of which the one contact and trailer intimately and conformally move as the contacts move apart. Both intimate, conformal movements physically isolate the one contact from the chamber and the other contact.

In the improved switch, the trailer and the liner comprise an abrasion-resistant, high surface lubricity, non-brittle, ultra high molecular weight polyethylene. Constituting the trailer and liner in this fashion prevents the trailer and the wall of the liner's bore from being abraded by the intimate and conformal movement and permits the movable contact to freely move through the bore while permitting free movement of the trailer through the chamber and the bore. As a consequence, free movement of the movable contact and of the trailer, upon pressurization of the chamber, is not compromised. Further, the trailer and the liner remain integral and do not shatter or crack during application of the high force or during movement of the movable contact and the trailer.

In one alternative embodiment of the improved high-voltage switch, there is also included a facility for connecting together the trailer to the movable contact at an interface therebetween. A disk of relatively inflexible material is located between the trailer and the one contact at the interface. The disk has a size and shape coincident with the cross-section of the trailer. The disk prevents the high forces applied to the trailer by the pressurization of the chamber from extruding the trailer about and around the movable contact. As a consequence, the conformal and intimate movement of the movable contact and of the trailer is not compromised. Preferred materials for the disk are those sold under the trademarks Lexan and Nylon.

In another alternative embodiment, the improved high-voltage switch described above is used in a current-limiting interrupting module. The switch is in electrical shunt with the fusible element of the module and the switch and the fusible element are within a common housing. Opening of the current path due to separation of the contacts commutates current in the switch to the fusible element for interruption thereof. The fusible element is proximately related to the switch so that thermal energy produced therein by current interruption heats the switch. The further improvement comprises a diametrical increase formed in a portion of the bore of the liner remote from the stationary contact. The diametrically increased portion of the bore and either the movable contact or its trailer, define a relief cavity or volume. The liner may expand into the relief cavity or volume as it is heated by the thermal energy generated by the fusible element without adversely affecting the integrity of the module and of its housing. Preferably, the extent of the diametrical increase parallel to the line of movement of the contacts is not so long as to compromise the isolation of the movable contact, which isolation is effected by the conformal and intimate reception of the trailer in the bore. That is, there remains a substantial portion of the bore located between the relief cavity and the stationary contact which is available for conformal and intimate reception of the trailer to effectively isolate the movable contact from the other contact and from the chamber.

DETAILED DESCRIPTION

Figure 1:
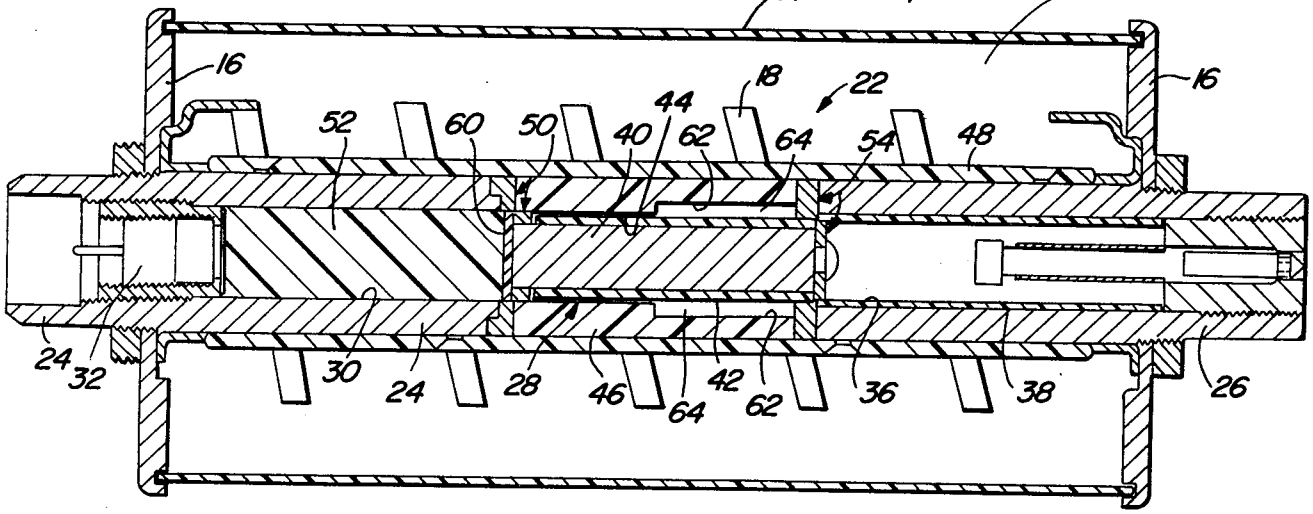
FIG. 1 is a partially sectioned, side elevation of a current-limiting interrupting module which includes an improved high-voltage switch according to the present invention.

The present invention relates to an improved current-limiting interrupting module 12. Because the module 12 is more completely described in the above-referenced commonly assigned U.S. patent and patent applications, it is only generally depicted in the drawing hereof and only generally described herein.

The module 12 includes a generally cylindrical open-ended insulative housing 14, which is closed by end plates 16. The closed housing 14 surrounds a current-limiting fusible element 18 helically wound around a central axis of the housing 14 and a mass of a particulate fulgurite-forming medium 20, such as silica sand. The silica sand 20 is in intimate engagement with the fusible element 18. The fusible element 18, which may be a silver or copper, and the sand 20 interrupt fault currents or other over-currents therethrough in a current-limiting or energy-limiting manner, according to well-known principles. The fusible element 18 may be similar to those disclosed in commonly assigned U.S. Pat. application, Ser. No. 194,712, filed Oct. 6,1980, or U.S. Pat. No. 4,359,708 or Ser. No., 437,726, filed Oct. 29, 1982, both in the names of Jarosz and Panas.

The housing 14 also surrounds a switch 22 around which the fusible element 18 may be maintained in its helical configuration by a support (not shown), such as that disclosed in commonly assigned U.S. Pat. application, Ser. No. 181,603, filed Aug. 27, 1980 in the names of Jarosz and Panas. Although the switch 22 may have numerous constructions in accordance with the previously noted commonly assigned U.S. patent and patent applications, an exemplary embodiment is depicted in FIG. 1.

Specifically, the switch 22 includes a first conductive member 24 which is stationarily mounted to the left end plate 16 and a second conductive member 26 which is stationarily mounted to the right end plate 16. The first conductive member 24 serves as a stationary contact of the switch 22, while the second conductive member 26 serves as a stationary terminal of the switch 22. The ends of the fusible element 18 are electrically continuous with the conductive members 24 and 26 by facilities not described herein.

The switch 22 also includes a movable contact 28. Normally, the movable contact 28 is electrically continuous with both conductive members 24 and 26 so that a continuous low-resistance electrical path is formed between the members 24 and 26 via the movable contact 28. Because the resistance of this path is lower than the resistance of the fusible element 18, while the switch 22 is closed, as depicted in FIG. 1, the majority of the current flowing through the module 12 is normally shunted by the switch 22 away from the fusible element 18. When the switch 22 opens, as described below, the current formerly flowing through the members 24 and 26 and the movable contact 28 is commutated to the fusible element 18 for interruption.

In specific embodiments, the first conductive member or stationary contact 24 may have a central bore 30. At the left end of the central bore 30, a power cartridge 32, or other pressure-generating device, is located. The second conductive member or stationary terminal 26 also contains a central bore 36. This bore 36 may be lined with an insulative sleeve 38.

The movable contact 28 comprises a cylindrical conductive member 40 surrounded by an insulative sleeve 42. The movable contact 28 is normally located centrally between the conductive members 24 and 26 and within the bore 44 of an insulative member or liner 46 centrally held between the conductive members 24 and 26.

The conductive members 24 and 26 are maintained in an aligned relationship, and the liner 46 is held in place therebetween, by an insulative housing 48 which surrounds the conductive members 24 and 26 and is mounted thereto in any convenient manner. As shown in FIG. 1, the fusible element 18 of the module 12 may be helically maintained about the housing 48 by structure not shown in FIG. 1. This structure may comprise a pair of notched fins attached to the housing 48, as described in commonly assigned co-pending U.S. Pat. application, Ser. No. 181,603, filed Aug. 27, 1980 in the names of Jarosz and Panas.

With the movable contact 28 occupying the position shown in FIG. 1, the conductive member 40 thereof is electrically interconnected to the conductive member 24 by a conductive diaphragm 50 or other metallic member, which is shearable, tearable or the like. To the left of the diaphragm 50, the conductive member 40 carries an insulative trailer or piston 52. In the normal position of the movable contact 28 shown in FIG. 1, the trailer 52 normally occupies the central bore 30 of the first conductive member 24.

The right end of the conductive member 40 is normally electrically interconnected to the second conductive member 26 by a diaphragm 54, which may be similar to the diaphragm 50. The interior of the insulative sleeve 38 is sufficiently large to conformally receive the conductive member 40 with its insulative sleeve 42 thereon. Further, the bore 44 of the liner 46 is sufficiently large to conformally receive both the conductive member 40 with the insulative sleeve 42 thereon and the trailer 52.

In the normal condition of the module 12, as shown in FIG. 1 and as previously described, the switch 22 carries all or a majority of the current flowing in a protected high-voltage circuit (not shown) to which the module 12 is connected. This current flows through the conductive members 24 and 26, the diaphragms 50 and 54, and the movable contact 28. Little or no current normally flows through the fusible element 18. Should a fault current or other over-current occur in the protected circuit (not shown) to which the fuse 12 is connected, apparatus (not shown) detects this condition and ignites the power cartridge 32. Ignition of the power cartridge 32 causes it to evolve large quantities of high-pressure gas which acts on the left end of the trailer 52. The force applied to the trailer 52 by the high pressure moves the trailer 52 rightwardly and also moves rightwardly the movable contact 28 (i.e., the conductive member 40 with the insulative sleeve 42 thereon). Rightward movement of the trailer 52 and of the movable contact 28 severs, rips or tears the diaphragms 50 and 54, thereby breaking the electrical interconnection between the movable contact 28, on the one hand, and both conductive members 24 and 26, on the other hand. Two gaps are thereby opened by the switch 22. The first gap exists between the left end of the conductive member 40, the right end of the first conductive member 24, while the second gap exists between the right end of the conductive member 40 and the left end of the second conductive member 26. Both gaps are insulated. Specifically, the first gap is insulated by the conformal reception of the trailer 52 within the bore 44 of the sleeve 46. The second gap is insulated by the conformal reception of the insulative sleeve 42 within the bore 44 of the insulative member 46. The conformal reception of the trailer 52 by the bore 44 of the insulative member 46 also isolates the movable contact 28 from the ignition products of the power cartridge 32, which may contain electrically conductive, arc-promoting materials.

When the switch 22 opens, the current previously flowing therethrough is commutated to the fusible element 18. The action of the fusible element 18 and of the silica sand 20 ultimately extinguishes this current, as is well known.

It is generally desirable that the before, during and after its operation, the module 12 remain wholly integral. The integrity of the module 12 and of its housing 14 and end plates 16 is particularly essential before operation of the module 12. Specifically, the housing 14, the end plates 16, and the members 24 and 26 should remain integral and sealed together so that contaminants or the like do not enter the housing to adversely effect the operation of either the fusible element 18 or the switch 22. During and after operation of the module 12 it is desirable that the housing 14 and the end plates 16 remain integral and sealed together, for example, to prevent the escape of hot, ionized gas which might adversely affect nearby high-voltage equipment.

After numerous experiments with the module 12, it has been found that the insulative sleeve 38, the insulative sleeve 52, the liner 46, and the trailer 42 need not necessarily be made of arc-extinguishing materials. Specifically, these numerous experiments have shown that little, if any, arcing occurs between the movable contact 28 and the stationary contact or first conductive member 24 as they separate. The fact that little or no arcing occurs is thought to be due both to the immediate commutation of current normally flowing in the switch 22 to the fusible element 18 and to the immediate conformal and intimate reception of the trailer 52 within the bore 44 of the liner 46.

Most arc-extinguishing materials are costly, are subject to abrasion, have low-surface lubricity, or are somewhat brittle. It would be desirable to find a lower-cost insulative material, which need not have good arc-extinguishing properties, but which exhibits abrasion resistance, high surface lubricity, and non-brittleness to substitute for the arc-extinguishing materials from which the insulative sleeve 38, the insulative sleeve 42, the liner 46, and the trailer 52 of the above-noted patents and applications were made. Materials which are subject to abrasion may compromise the movement of the movable contact 28 away from the stationary contact 24. Specifically, the various conformal and intimate interfaces between the trailer 52 and the bore 44 of the liner 46, as well as the movement of the insulative sleeve 42 through that bore 44 and, in addition, the movement of the insulative sleeve 42 through the insulative sleeve 38 can abrade a low-abrasion-resistant material. Such abrasion may create frictional forces which are sufficiently high to prevent or compromise free movement of the movable contact 28. Additionally, it must be remembered that, as the movable contact 28 moves rightwardly, it carries with it portions of the diaphragms 50 and 54. These diaphragm portions may similarly abrade either the bore 44 of the liner 46 or the interior of the sleeve 38. Again, this abrasion may have the effect of preventing free movement of the movable contact 28.

Also, most arc-extinguishing materials do not have high surface lubricity. If a material having high surface lubricity could be substituted for the prior arc-extinguishing materials, free movement of the movable contact 28, notwithstanding the various intimate and conformal relationships of the parts, could be enhanced. Lastly, many arc-extinguishing materials, such as those sold under the trademarks Lucite or Delrin, are brittle. Of crucial importance regarding brittleness Is the fact that the trailer 52 receives high forces due to the ignition of the power cartridge 32. It has been found that many standard arc-extinguishing materials shatter or crack upon having these forces applied directly thereto. Shattering, cracking or other disintegration of the trailer 52 can prevent or otherwise compromise free movement of the movable contact 28.

The present invention contemplates fabricating the sleeve 38, the sleeve 42, the liner 46, and the trailer 52 from an ultra high molecular weight polyethylene, such as that sold under the trade name U.H.M.W.P.E. by Westlake Plastic Company of Lenni, Pennsylvania 19052. Ultra-high molecular weight polyethylene is abrasion resistant, has high surface lubricity, and is non-brittle, thereby obviating the above described problems. Additionally, although not an outstanding arc-extinguishing material, polyethylene does have some arc-extinguishing ability and evolves some arc-extinguishing gas upon exposure thereof to the heat of a high-voltage arc. However, as already noted, the polyethylene parts will, in general, not be called on to exhibit any substantial arc-extinguishing properties, inasmuch as experimentation has shown that little, if any, arcing actually occurs between the movable contact 28 and the stationary contact 24 as they separate.

The use of ultra high molecular-weight polyethylene ensures free movement of the movable contact 28 and of the trailer 52 attached thereto. This free movement of the movable contact 28 is achieved without compromising the electrical characteristics of the switch 22, which, as noted above, are not crucial when the switch 22 is in electrical shunt with the fusible element 18. Ultra high molecular weight polyethylene does exhibit two properties which may, if not taken into account, somewhat compromise the operation of the switch 22.

Specifically, ultra high molecular-weight polyethylene is somewhat softer than standard arc-extinguishing materials, such as that sold under the trademarks Lucite and Delrin. As a consequence, when the high forces are applied to the left end thereof by ignition of the power cartridge 32, it has been found that the right end of the trailer 52 may extrude about and around the left end of the conductive member 40 of the movable contact 28. In order to prevent this extrusion, the trailer 52 and the conductive member 40 are connected together in any convenient manner and, at the interface between these two elements, there is located a disk 60 of relatively inflexible material. The disk, which may be made from Lexan or Nylon, has the same size and shape as the cross-section of the trailer 52. The disk 60 is thereby made sufficiently large to prevent extrusion of the trailer 52 about and around the conductive member 40. Prevention of the extrusion of the trailer 52 about or around the conductive member 40 obviates compromising of the free movement of the movable contact 28 to the right.

Additionally, ultra high molecular-weight polyethylene has a somewhat higher coefficient of thermal expansion than standard arc-extinguishing materials. As can be seen from FIG. 1, the switch 22 and the fusible element 18 are both contained in the housing 14 and the fusible element 18 is somewhat proximate to the switch 22. When the fusible element 18 interrupts current commutated thereto, thermal energy is generated thereby. It has been found that sufficient thermal energy can be generated by the fusible element 18 in interrupting the commutated current to cause expansion of the liner 46. Such expansion of the liner 46, it has been found, may be sufficiently great to force the various elements contained within the housing 48—particularly the members 24 and 26—outwardly of the module 12 or to deform the end plates 16 or break the seal between such end plates 16 and the housing 14. It is not desirable that the housing 14 or the end plates 16 become disintegral, deformed or otherwise detached during and following operation of the module 12.

In order to prevent this from happening, the bore 44 of the liner 46 is relieved, undercut or diametrically increased in size, as shown at 62. This provides a relief cavity or volume 64. Should interruption of a fault current or other overcurrent by the fusible element 18 generate sufficient heat to cause undue expansion of the liner 46, the relief cavity or volume 64 provides a space into which the material of the liner 46 can expand. Such expansion into the relief cavity or volume 64 prevents outward forces or pressure from being applied to the housing 14, to the end plates 16, and to the members 24 and 26, thus ensuring that the module 12 remains integral during and following operation thereof. It should be noted that the undercut or relief 62 extends along the line of direction of separation of the contacts 24 and 28 only by an amount sufficient for the liner 46 to expand without adversely effecting the function of the module 12. That is to say, a sufficient extend of the bore 44 formed through the liner 46 remains for intimate and conformal engagement of both the insulative sleeve 42 on the conductive member 40 and of the trailer 52, as each moves therethrough. This conformal or intimate engagement is, of course, necessary to isolate the movable contact 28 from the ignition products of the power cartridge 32 and from the stationary contact 24.

We claim:

1. An improved high-voltage electrical switch for opening a current path in which the switch is included, the switch having a pair of normally interconnected contacts which are relatively movable apart along a fixed line of direction to form a first gap therebetween and to open the current path; an insulative trailer carried by one of the contacts defining an enclosed chamber with the other contact when the contacts are interconnected, the trailer being intimately and conformally received in and movable through the chamber; means for pressurizing the chamber and applying high force to the trailer to rapidly drive the contacts apart, and an insulative liner through a bore of which the one contact and the trailer intimately and conformally move as the contacts move apart, the intimate, conformal movement physically isolating the one contact from the chamber and the other contact and insulating the first gap; wherein the improvement comprises:

the trailer and the liner comprising abrasion-resistant, high surface lubricity, non-brittle, ultra high molecular weight polyethylene, so that neither the trailer nor the wall of the bore are abraded by the intimate and conformal movement and so that there occurs free movement of the one contact through the bore and free movement of the trailer through the chamber and the bore, whereby free movement of the one contact and the trailer is not compromised, and further so that the trailer and the liner remain integral during movement of the one contact and the trailer.

2. An improved high-voltage electrical switch as in claim 1 and of the type further having a stationary terminal normally electrically interconnected with the one contact, movement apart of the contacts intimately and conformally telescoping the one contact into a passageway in the terminal, the one contact and the wall of the passageway being covered with an insulative material so that a second insulated gap between the one contact and the terminal is formed; wherein the improvement further comprises:

the insulative material covering the one contact and the wall of the passageway comprising abrasion-resistant, high surface lubricity, non-brittle, ultra high molecular weight polyethylene, so that the wall of the bore, the material covering the wall of the passageway, and the material covering the one contact are not abraded by the intimate and conformal movement and so that there occurs free movement of the one contact through both the bore and the passageway, whereby free movement of the one contact and the trailer is not compromised, and further so that the material covering the one contact and the wall of the passageway remain integral during movement of the one contact.

3. An improved high-voltage switch as in claim 2, which further comprises means for connecting the trailer to the one contact at an interface therebetween, and a disk of relatively inflexible material between the trailer and the one contact at the interface, the disk having a size and shape coincident with the cross-section of the trailer for preventing forces applied to the trailer by the pressurizing means from extruding the trailer about and around the one contact, whereby the conformal and intimate movement of the one contact and the trailer is not compromised.

4. An improved high-votlage switch as in claim 3, wherein:

the disk is Lexan or Nylon.

5. A current-limiting interrupting module which includes the improved high-voltage switch of claim 4 in electrical shunt with a fusible element, the switch and the fusible element being within a common housing, opening of the current path commutating current in the switch to the fusible element for interruption thereof, the fusible element being proximate to the switch so that thermal energy produced by current interruption heats the switch; wherein the improvement further comprises:

a diametrical increase formed in a portion of the bore of the liner remote from the other contact, the diametrically increased portion of the bore and either the one contact or the trailer defining a relief cavity or volume into which the liner may expand as it is heated by the thermal energy without affecting the integrity of the module or the housing.

6. An improved module as in claim 5, wherein:

the extent of the diametrical increase parallel to the line of movement is not so long as to compromise the isolation of the one contact effected by the conformal and intimate reception of the trailer by that portion of the bore which resides between the relief cavity and the other contact.

7. A current-limiting interrupting module which includes the improved high-voltage switch of claim 1 in electrical shunt with a fusible element, the switch and the fusible element being within a common housing, opening of the current path commutating current in the switch to the fusible element for interruption thereof, the fusible element being proximate to the switch so that thermal energy produced by current interruption heats the switch; wherein the improvement further comprises:

a diametrical increase formed in a portion of the bore of the liner remote from the other contact, the diametrically increased portion of the bore and either the one contact or the trailer defining a relief cavity or volume into which the liner may expand as it is heated by the thermal energy without affecting the integrity of the module or the housing.

8. An improved module as in claim 7, wherein:

the extent of the diametrical increase parallel to the line of movement is not so long as to compromise the isolation of the one contact effected by the conformal and intimate reception of the trailer by that portion of the bore which resides between the relief cavity and the other contact.

9. An improved high-voltage switch as in claim 1, which further comprises means for connecting the trailer to the one contact at an interface therebetween, and a disk of relatively inflexible material between the trailer and the one contact at the interface, the disk having a size and shape coincident with the cross-section of the trailer for preventing forces applied to the trailer by the pressurizing means from extruding the trailer about and around the one contact, whereby the conformal and intimate movement of the one contact and the trailer is not compromised.

10. An improved high-voltage switch as in claim 9, wherein:

the disk is Lexan or Nylon.

* * * * *